US005515689A

United States Patent [19]

Atterbury

[11] Patent Number: 5,515,689

[45] Date of Patent: May 14, 1996

[54] DEFROSTING HEAT PUMPS

[75] Inventor: William G. Atterbury, Columbus, Ohio

[73] Assignee: Gas Research Institute, Chicago, Ill.

[21] Appl. No.: 220,259

[22] Filed: Mar. 30, 1994

[51] Int. Cl.[6] ..... F25D 21/06

[52] U.S. Cl. ..... 62/80; 62/155; 62/156

[58] Field of Search ..... 62/155, 154, 151, 62/152, 153, 156, 234, 80, 81, 82; 165/17

[56] References Cited

U.S. PATENT DOCUMENTS

| | | | |
|---|---|---|---|
| 4,156,350 | 5/1979 | Elliott et al. | 62/80 |
| 4,521,988 | 2/1981 | Allard et al. | 62/80 |
| 4,563,877 | 1/1986 | Harnish | 62/80 |
| 4,590,771 | 5/1986 | Shaffer et al. | 62/156 |
| 4,627,483 | 12/1986 | Harshbarger, III et al. | 165/2 |
| 4,680,940 | 7/1987 | Vaughn | 62/155 |
| 4,689,965 | 9/1987 | Janke et al. | 62/155 |
| 4,694,657 | 9/1987 | Vaughn | 62/80 |
| 4,751,825 | 6/1988 | Voorhis et al. | 62/234 |
| 4,850,204 | 7/1989 | Bos et al. | 62/234 |
| 4,852,360 | 8/1989 | Harshbarger, Jr. et al. | 62/126 |
| 4,882,908 | 11/1989 | White | 62/155 |
| 4,916,912 | 4/1990 | Levine et al. | 62/80 |
| 4,974,418 | 12/1990 | Levine et al. | 62/156 X |
| 5,161,383 | 11/1992 | Hanson et al. | 62/155 X |

*Primary Examiner*—Harry B. Tanner
*Attorney, Agent, or Firm*—Dick and Harris

[57] ABSTRACT

Methods and apparatus for defrosting the outdoor coil in a variable speed heat pump system including determining, after the end of the last preceding defrosting, the optimal time to begin the next defrosting, and then initiating the defrosting responsive to the time interval since the end of the last defrosting tsD, the averages, over time, of liquid line temperature LLT, speed ES of the engine that drives the compressor, and outdoor dry bulb temperature ODT. The defrosting includes switching the system to the defrost mode at a predetermined maximum engine speed, periodically measuring the time taken during the defrosting ttD and the liquid line temperature LLT; periodically computing the rate of change of LLT with respect to time ΔLLT/Δt, and when ΔLLT/Δt is greater than the previous maximum value and ttD is greater than a predetermined time, storing the value of each in place of its preceding value. The defrosting ends when LLT becomes greater than a first predetermined temperature, or has been greater than a second predetermined temperature for at least a predetermined time; or a predetermined maximum time for defrosting MPDI has elapsed.

15 Claims, 8 Drawing Sheets

DEFROSTING HEAT PUMPS

FIELD

This invention relates to methods and apparatus for defrosting heat pumps. It is especially useful for defrosting variable speed heat pumps, typically refrigerant vapor compression heat pump systems that are driven by combustion engine prime movers.

The following United States patents are directed to apparatus of a general type for which the present invention is especially advantageous.

U.S. Pat. No. 4,991,400 issued Feb. 12, 1991, to William H. Wilkinson for Engine Driven Heat Pump with Auxiliary Generator.

U.S. Pat. No. 5,003,788 issued Apr. 2, 1991, to Robert D. Fischer for Gas Engine Driven Heat Pump System.

U.S. Pat. No. 5,020,320, issued Jun. 4, 1991, to Sherwood G. Talbert and Frank E. Jakob, for Engine Driven Heat Pump System.

U.S. Pat. No. 5,029,449 issued Jul. 9, 1991, to William H. Wilkinson for Heat Pump Booster Compressor Arrangement.

U.S. Pat. No. 5,099,651 issued Mar. 31, 1992, to Robert D. Fischer for Gas Engine Driven Heat Pump Method.

U.S. Pat. No. 5,249,742 issued Oct. 5, 1993, to William G. Atterbury, Douglas E. Boyd, Jan B. Yates, and Lee R. Van Dixhorn for Coolant Circulation System for Engine Heat Pump.

The patents cited above are incorporated herein by reference.

The invention can be employed to advantage in other types of systems also, such as electrically driven systems, whether operable at variable speeds or only at fixed speeds.

BACKGROUND

Air-to-air heat pumps and refrigeration systems often must operate under conditions that cause frost to form on the evaporator. To prevent build up of frost, which causes coil blockage and loss of capacity, such systems must have a method of periodically defrosting the coil. Most modern heat pump systems (as well as refrigeration systems) employ a reverse cycle defrosting scheme whereby the refrigeration circuit is reversed to melt frost, snow, and ice from the coil. Various methods of determining when to initiate and when to terminate the defrosting cycle have been employed, from simple time based schemes to complex demand schemes. A true demand method is preferable because it causes the system to defrost only when necessary, thereby improving system efficiency and availability.

One demand scheme centers around measurement and use of the temperature of the outdoor coil liquid line, (for short, liquid line temperature (LLT)). This temperature will drop as frost forms on and begins to block the coil. However, the LLT is sensitive also to a number of other parameters such as outdoor dry bulb temperature (ODT), outdoor wet bulb temperature, outdoor coil airflow, indoor temperature, indoor coil airflow, and system speed. A number of schemes have been employed for adapting the defrosting logic to changing weather conditions for a fixed speed system using the LLT and the rate of change of the LLT, as in U.S. Pat. No. 4,590,771, Jacob E. Shaeffer et al, and U.S. Pat. No. 4,563,877, James R. Harnish.

These schemes appear to be inadequate when applied to a variable speed system because of the effects of many other parameters, especially system speed, on the LLT. FIG. 8 shows how the difference between the LLT and the ODT varies under normal operating conditions at various systems speeds.

Ideally a defrosting system would turn on only when the frost buildup had reduced the system efficiency by a certain percentage, and would remain on only until the frost had been removed. Various control methods and apparatus have been devised for that purpose.

U.S. Pat. No. 4,751,825, issued Jun. 21, 1988, to Roger Voorhis et al. for Defrost Control For Variable Speed Heat Pumps points out that known methods of determining the degree of frost buildup on the coil include using photo-optical techniques, sensing the speed of the fan, and measuring the difference in the refrigerant pressure between the inside and the outside coil. All of them have disadvantages. Another approach, employed in some demand defrost systems, comprises sensing the temperature differences between the coil and the ambient air and, when the difference reaches a predetermined level, initiating the defrost cycle. This requires two sensors, typically thermistors. Those available at reasonable cost have inherent differences such that when a pair are used, it is necessary to conduct a calibration process for each individual system, which can be time consuming and expensive. Some other types of sensors are reasonably accurate without calibration, but are too expensive to use in an adaptive defrost system.

The Voorhis et al. patent discloses an adaptive defrost system for a variable speed heat pump wherein the time between defrosts is continuously updated by multiplying the last time between defrosts by a ratio of the desired and actual differences between the pre-defrost and after-defrost saturated coil temperatures. The same thermistor is used for both pre and after-defrost measurements, so calibration is not required.

The compressor speed is measured at only one point during the defrost cycle, however, and that only for the purpose of storing it in memory to return to the same speed after running the compressor at maximum speed during the defrosting period. The compressor must operate at this specified speed until the system reaches a steady state condition so that the appropriate saturated coil temperature measurement can be made. During this time period, the system is not capable of operating at the speed necessary to meet the desired load commanded by the thermostat.

The present invention is not so limited. It is based on different principles, and provides substantial improvements and advantages over the known prior art.

DISCLOSURE

The present invention comprises methods and apparatus for adaptive demand defrosting, and is particularly advantageous in variable speed heat pumps. Existing demand defrosting techniques are capable of determining when to defrost but may not be effective when used with a variable speed system. The adaptive demand defrost method herein not only determines when to defrost a variable speed system, but modifies the interval between defrosts to optimize the complete-cycle performance of the system under frosting conditions. Developed for application to a variable speed gas-engine heat pump (GHP), the method is adaptable to any variable or fixed speed system.

The major objective of a heat pump defrosting scheme is to prevent excessive buildup of frost on the evaporator that would cause a reduction of effective coil area and a loss in capacity and performance. The second most important objective of the reverse cycle defrost scheme is to avoid defrosting when it is not necessary; because the defrost cycle removes heat from the house, consumes energy, and reduces availability of the system to heat the house. Unfortunately, these two objectives are somewhat mutually exclusive. At best an approximately optimum defrost cycle can be achieved that keeps the coil relatively clear, while not causing the system to defrost too often or too long.

Many demand based defrosting schemes sense the need to defrost by looking at certain system parameters such as the liquid line temperature. Most known methods are far from optimum. The most reliable method of determining when, and how much defrosting is necessary is to execute a defrosting and determine how long the defrost cycle took. Examination of the length of the defrost and the interval between defrosts in hindsight will show whether a defrost was necessary. This information cannot be used to change prior performance of the system, but it can be used to adapt the initiation and length of future defrost cycles to the ambient conditions and the operating conditions of the system.

Typically, according to the present invention, examination of the last previous defrost cycle reveals the time between the end of one defrosting and the start of the next one, commonly called the defrost interval (DI), and the actual time required to defrost (ttD). The predicted defrost interval (PDI) to the next defrost cycle is then determined by comparing the ttD with the optimal time to defrost (OttD) as follows:

$$PDI = DI * \frac{OttD}{ttD} * SSA$$

Better control response can be achieved by applying a step size accelerator (SSA) to the PDI. A step size accelerator greater than one causes a rapid change in the defrost interval, while a SSA less than one produces a slower and more stable response. This step size accelerator will be different for increasing the PDI (when OttD>ttD) and decreasing the PDI (when ttD>OttD) and a preferred value is developed empirically specific to a heat pump design and climate based on operating response to changing weather conditions. Increased response of the adaptive method can be achieved by setting the step size accelerator to a value greater than one. The time since defrost (tsD) from termination of the most recent defrost to the current time is compared to the PDI. When the tsD reaches the PDI, a defrost cycle is initiated.

The time since defrost includes elapsed time only while the system is running, not while the system is off. The tsD is increased only when LLT is less than 32° F. and is reset to zero whenever the LLT is greater than about 36° F., for a significant period of time, typically about five minutes. If the system should cycle off, the tsD will be decreased by a fraction of the elapsed time as a function of ODT when ODT is greater than about 36° F., so that credit may be taken for frost melting when the system is not operating. When a defrosting is initiated, the defrost interval DI may be determined by saving the value of tsD.

A defrost scheme as described above should have minimum and maximum permitted DI's (mPDI and MPDI, respectively) as well as a default predicted PDI (dPDI). A typical dPDI would be ⅔ * minimum time+⅓ * maximum time for an initial time period (controller initialization, typically more than about 72 total hours since the last defrost). Typically the DI's would be predetermined empirically for each of several different geographical regions having different climates, and could be conveniently set for each installation as a pin or software selectable parameter value. The PDI is never less than the minimum permitted DI, or greater than the maximum permitted DI.

The tsD's are referenced to time spent at the maximum system speed, based on the capacity ratio of the equipment, and are integrated over time. The capacity ratio is defined as the total heating (or cooling) output of a system divided by the output at maximum speed for the same conditions. The capacity ratio of a variable speed GHP in the heating mode is shown in FIG. 9.

$$tsD = \frac{\text{actual elapsed time}}{\text{at present speed}} * \frac{\text{capacity at present speed}}{\text{capacity at maximum speed}}$$

The defrost cycle is normally performed at maximum system speed, so ttD does not normally require such modification. However, if another speed is selected, it can also be modified in the manner described above.

A specific optimum time to defrost OttD is selected at each outdoor temperature. This temperature is measured and averaged typically over one minute intervals, and the last reading before defrosting is initiated is selected as the outdoor temperature for which the OttD is computed.

This method is not necessarily optimal for the first defrosting after a sudden change in the weather, so the system must limit the defrost interval DI to prevent such occurrences from causing operational problems. If detected conditions suggest that a defrost is necessary before the PDI has passed, the system will force a defrosting, and at that time the DI will indicate whether the PDI should be increased or decreased to achieve an optimal defrost sequence as described above.

A typical recommended condition for forcing a defrosting is when the difference ODT−LLT is more than about 4° F. greater than the largest such difference at which the coil remains free from frost [ODT−LLT>4°+(ODT−LLT) at design conditions for a dry and clear coil]. This permits normal variations due to changing weather conditions. However, if the difference ODT−LLT exceeds the design condition for the speed by about four degrees, a defrost will be forced. The relationship between ODT and LLT for a variable speed system is shown in FIG. 8.

A typical defrost cycle sequence for the gas heat pump, GHP, is similar to a standard reverse cycle defrost of an electric heat pump, (EHP). The procedure is as follows:

a. the engine speed is ramped (increased or decreased) slowly to 1500 RPM b. the reversing valve is energized (to cooling mode)

c. the outdoor fan is turned off d. The engine speed is ramped (increased) slowly to maximum speed e. the defrost function is terminated when the outdoor coil temperature as detected by the liquid line temperature exceeds a selected value (typically about 70° F.)

f. the engine speed is ramped (decreased) rapidly to about 1500 RPM g. the reversing valve is de-energized (to heating mode)

h. the outdoor fan is turned back on i. the engine speed is returned to the speed requested by the house load demand The major difference between an EHP and a GHP during a defrost cycle is that a GHP can provide waste heat from the engine to provide warmer supply temperatures during the defrosting cycle. A variable speed system defrosts at maximum engine speed to permit the defrost cycle to be as short as possible so that the system may be returned to the heating mode as quickly as possible.

The ttD can be computed as the time required to melt frost and ice rather than the total time the system may be in the defrost mode. FIG. 10 shows the LLT during a typical defrost. By computing the ttD as the time to melt frost, much of the convective losses and losses due to heating the coil are eliminated, so that the measured ttD represents the actual time required to melt frost.

The defrosting sequence described above shows the outdoor fan being turned on immediately upon exiting from the defrost mode. This is the way most commercial systems operate. However, a performance increase, an increase in the efficacy of the defrosting cycle, as well as a potential reduction in the overall energy required to operate the outdoor fan, can be realized by delaying the energizing of the outdoor fan briefly after a defrosting is completed.

A delay in starting the outdoor fan allows more time for the condensate to drain from the coil before refreezing if the outdoor temperature is less than 32° F. During the delay, if the outdoor coil is warmer than the ambient temperature it will help to increase the suction pressure, and thus will improve the efficiency of the compressor. While the outdoor fan is off, the power required to operate the outdoor fan is also saved. So overall efficiency is increased.

Typically the outdoor fan is restarted when the outdoor coil temperature, as measured at the liquid line, drops below about 36° F. or below the ambient temperature, whichever is higher. Turning on the outdoor fan while the coil temperature is still above freezing helps to remove the condensate as a liquid before it can refreeze. Delaying the starting of the outdoor fan after a defrost improves the overall performance of the system and helps to offset the performance penalty for entering a defrosting cycle.

DRAWINGS

FIGS. 1–4 together form a flow chart showing the sequence of operations in a typical method according to the present invention for defrosting the evaporator coil in a variable speed heat pump system. FIGS. 1–4 together also form a block diagram representing apparatus comprising means for carrying out each operation, in the specified sequence, in a typical defrosting system according to the invention.

FIGS. 5 and 6 together form a schematic view of a typical gas engine driven heat pump system in which the present invention can be advantageously applied. Most of the outdoor unit is shown in FIG. 5; the rest of the outdoor unit is shown, along with the indoor unit, in FIG. 6.

CARRYING OUT THE INVENTION

Figure 1:
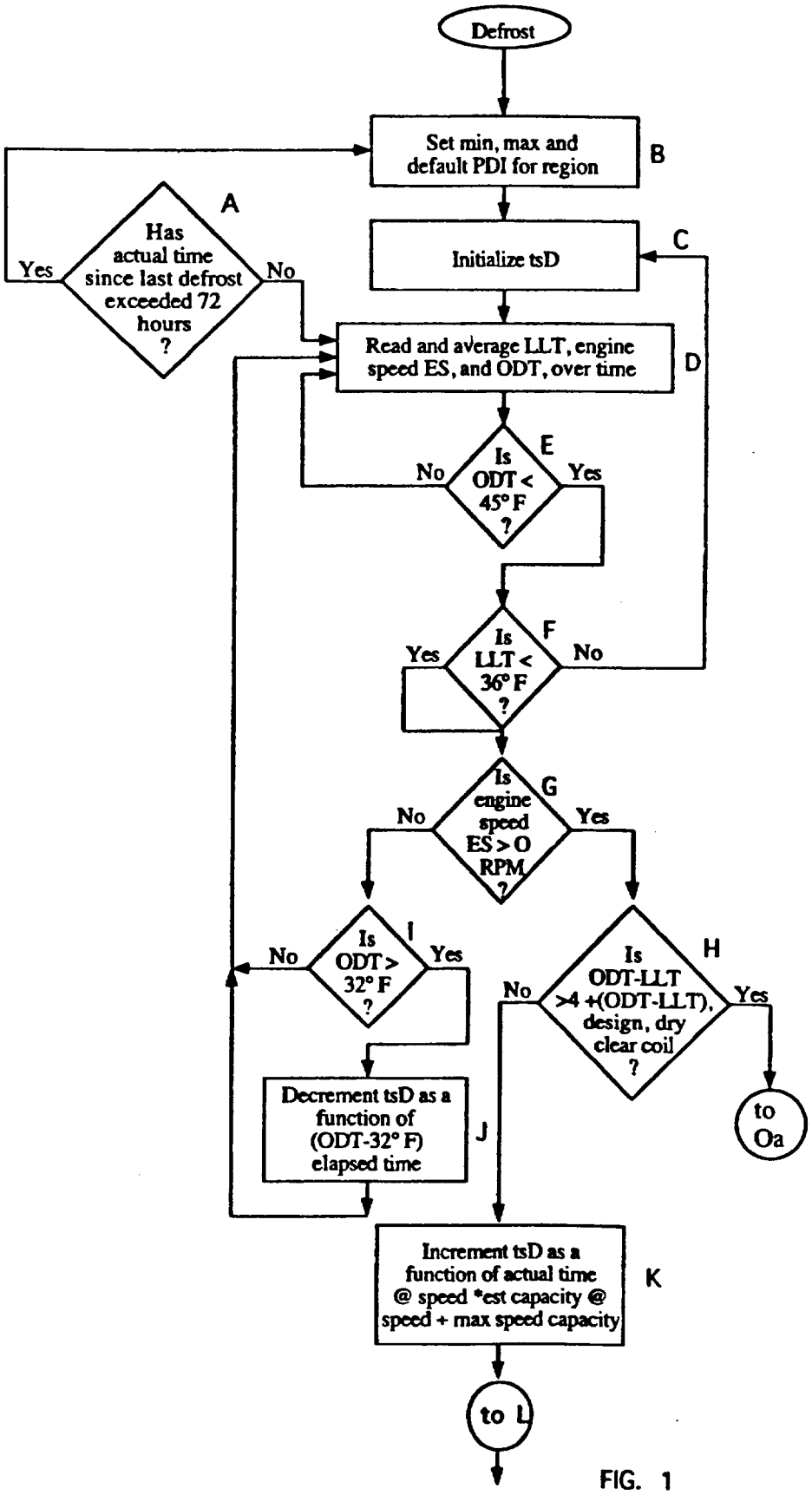
Figure 2:
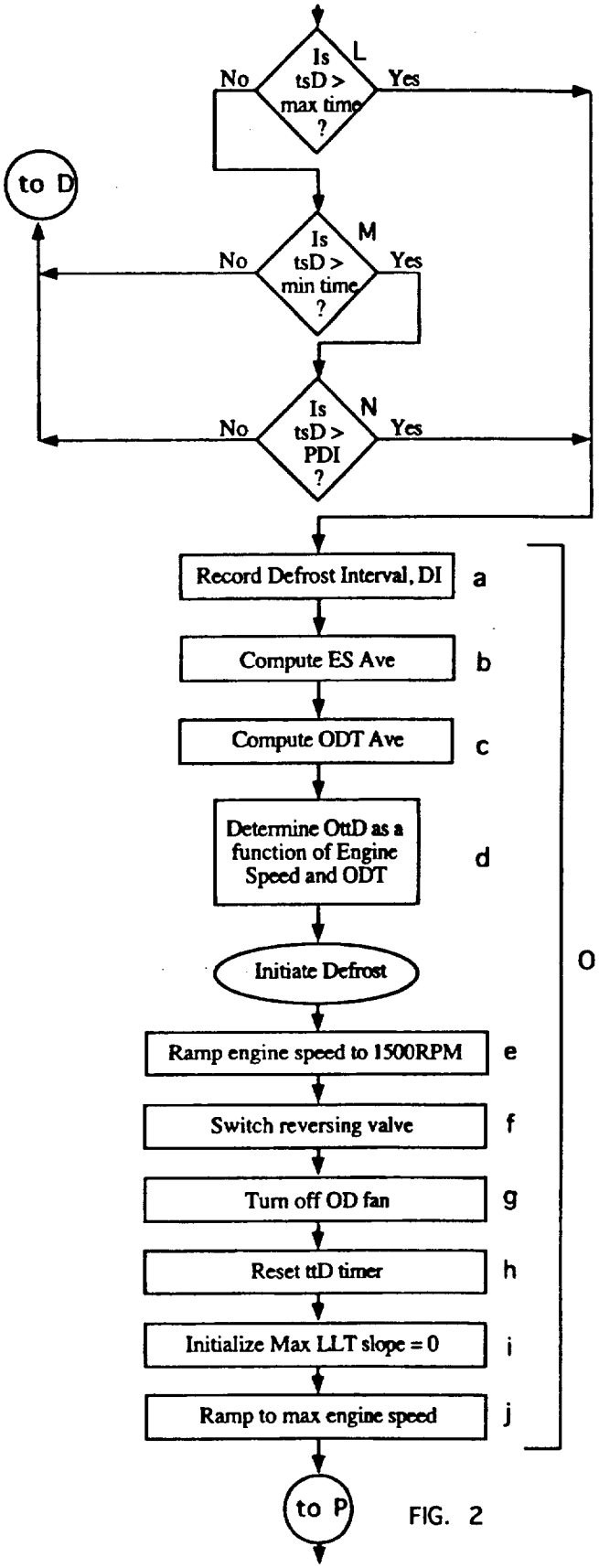

Referring now to FIGS. 1 and 2, in a typical method according to the present invention for defrosting the outdoor coil 24 in a heat pump system 20,21 having the components and parameters referred to herein; a typical method for determining, after the end of the last preceding defrosting, at least approximately the optimal time to begin the next defrosting, and then signalling the system to initiate the defrosting, comprises the steps a) either continuously or periodically measure the time interval since the end of the last defrosting tsD, the averages, over time, of liquid line temperature LLT, speed ES of the engine 40 that drives the compressor 22, and outdoor dry bulb 54 temperature ODT; and b) when one of the following conditions comes about:
   i. the difference ODT minus LLT exceeds a predetermined value (a function of the engine speed ES, if variable), indicating that the coil is not substantially clear of frost, or
   ii. tsD is greater than a predetermined maximum time interval to be permitted since the last defrosting MPDI, or
   iii. tsD is greater than a predetermined minimum time interval and is greater than a predicted defrost interval PDI that has been predetermined by data from the last defrosting, c) then provide a signal to initiate the defrosting.

Figure 3:
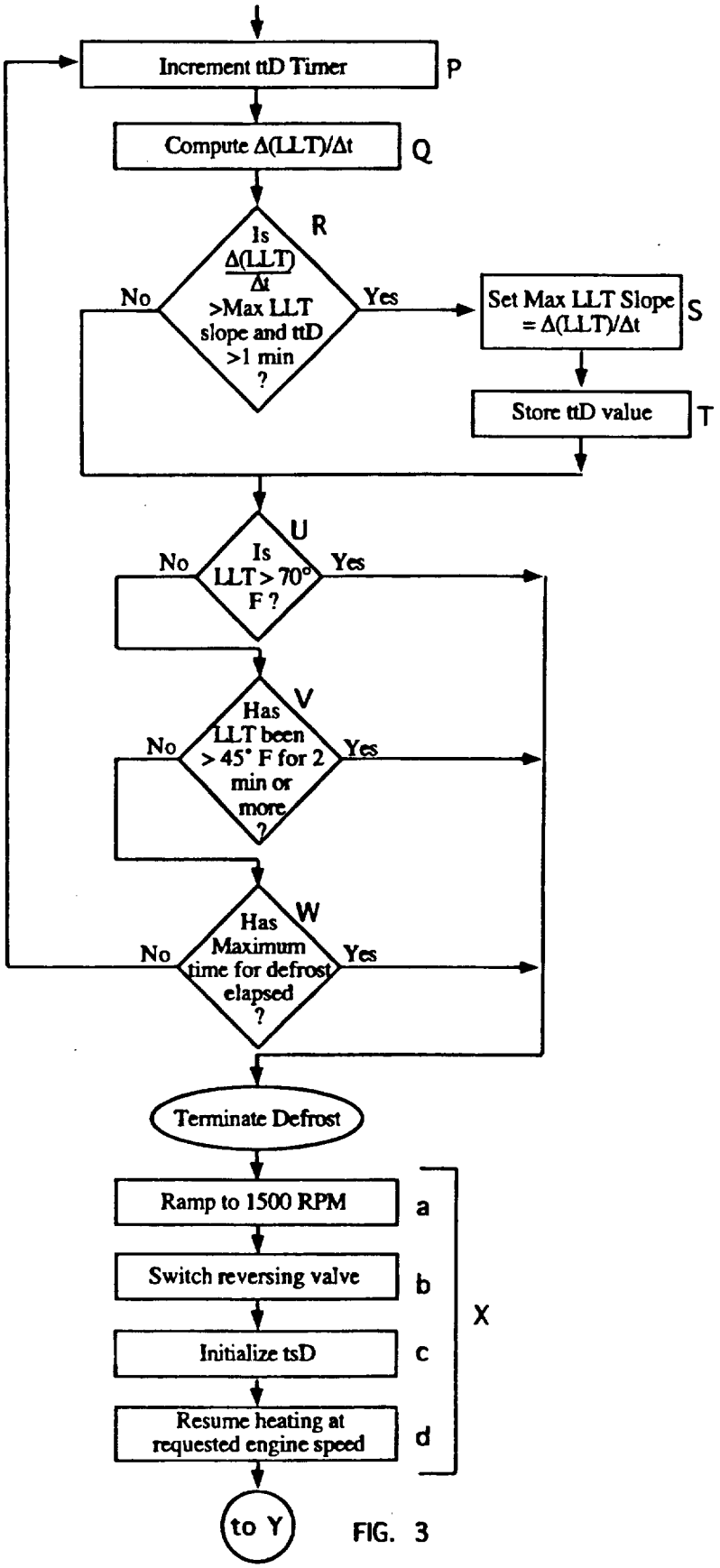

As illustrated in FIGS. 2 and 3, a typical method for carrying out the defrosting, and terminating it at least approximately at the optimal time, comprises the steps d) switch 30 the system to the defrost mode [at a predetermined maximum engine 40 speed pMES, if variable], e) periodically measure the time taken during the defrosting ttD and the liquid line 52 temperature LLT, f) periodically compute the rate of change of LLT with respect to time $\Delta LLT/\Delta t$, g) when $\Delta LLT/\Delta t$ is greater than the previous maximum value and ttD is greater than a predetermined time, store the value of each in place of its preceding value, h) when one of the following conditions comes about:
   i. LLT is greater than a first predetermined temperature, or
   ii. LLT has been greater than a second predetermined temperature for at least a predetermined time, or
   iii. a predetermined maximum time for defrosting MPDI has elapsed, i) then terminate the defrosting.

Figure 4:
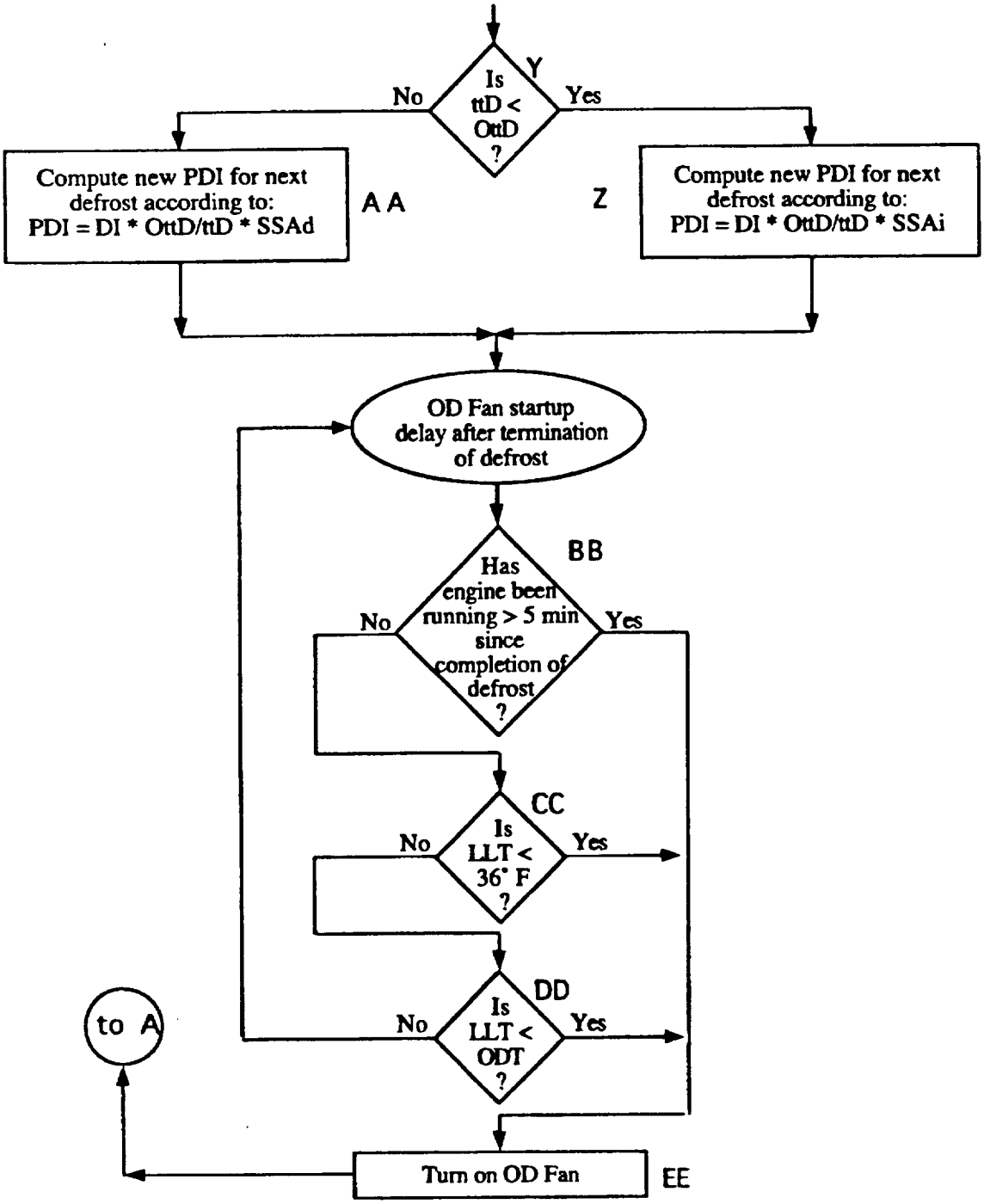

Referring now to FIGS. 3 and 4, in a variable speed heat pump system, a typical method comprises also, after step i), the steps j) switch 30 the system 20,21 to the heating mode, k) decrease the engine 40 speed ES to the speed requested by the thermostat, l) compute a predicted defrost interval PDI for the next defrosting, proportional to a predetermined optimal time to defrost OttD divided by ttD, and m) start the outdoor fan 50.

Typically, as shown in FIG. 4, the outdoor fan 50 is started when one of the following conditions comes about:

n) the engine 40 has been running for more than a predetermined time since its speed was decreased, or o) LLT is less than a predetermined temperature, or p) LLT is less than the outdoor dry bulb 54 temperature ODT.

More specifically a currently preferred method for determining at least approximately the optimal time to initiate a defrosting, and then signalling the system to begin the defrosting, typically comprises the steps A. a) if the time interval since the end of the last defrosting tsD is at least a predetermined maximum time MtsD, go to step B;

b) if not, go to step D;

B. set the respective system parameters to predetermined values of predicted defrost interval PDI: namely minimum mPDI, maximum MPDI, and default dPDI; and go to step C;

C. initialize the value of tsD to zero; and go to step D;

D. read and average, over time, the values of liquid line temperature LLT, speed ES of the engine that drives the compressor, and outdoor dry bulb temperature ODT; and go to step E;

E. a) if ODT is less than a predetermined higher temperature pHT, go to step F;

b) if not, go to step D;

F. a) if LLT is less than a predetermined lower temperature pLT, go to step G;

b) if not, go to step C;

G. a) if the engine is running, go to step H;

b) if not, go to step I;

H. a) if the difference ODT minus LLT exceeds a predetermined value for the current engine speed ES, and thus indicates that the coil is not substantially clear of frost, signal the system to begin the defrosting;

b) if not, go to step K;

I. a) if ODT is greater than a predetermined temperature, go to step J;

b) if not, go to step D;

J. reduce the value of tsD as a predetermined function of ODT and elapsed time, and go to step D;

K. increase the value of tsD as a predetermined function of the actual time at the present engine speed multiplied by the estimated capacity of the heat pump system at the present speed divided by the capacity at the maximum speed, and go to step L;

L. a) if tsD is greater than a predetermined maximum time permitted since the last defrost (maximum permitted defrost interval) MPDI, signal the system to begin the defrosting;

b) if not, go to step M;

M. a) if tsD is greater than a predetermined minimum time permitted since the last defrost (minimum permitted defrost interval) mPDI, go to step N;

b) if not, go to step D;

N. a) if tsD is greater than the PDI, signal the system to begin the defrosting;

b) if not, go to step D.

A currently preferred method for carrying out the defrosting, and terminating it at least approximately at the optimal time, typically comprises the steps O. a. record the defrost interval DI, b. compute the average engine speed AES, c. compute the average outdoor dry bulb temperature AODT, d. determine the optimal time to defrost OttD as an empirically predetermined function of AES and AODT, e. gradually reduce the engine speed ES to a predetermined engine speed pES, f. switch the reversing valve to the defrost mode, g. turn off the outdoor (OD) fan, h. reset to zero the timer that measures the time taken to defrost ttD, i. initialize the maximum value of the rate of change of LLT with respect to time MΔLLT/Δt equal to zero, and j. gradually increase the engine speed ES to a predetermined maximum engine speed pMES, and go to step P;

P. increment the timer that measures ttD, and go to step Q;

Q. compute the rate of change of LLT with respect to time ΔLLT/Δt, and go to step R;

R. a) if ΔLLT/Δt is greater than the previous maximum value and ttD is greater than a predetermined time, go to step S;

b) if not, go to step U;

S. set MΔLLT/Δt to ΔLLT/Δt and go to step T;

T. store the value of ttD and go to step U;

U. a) if LLT is greater than a predetermined temperature, terminate the defrosting;

b) if not, go to step V;

V. a) if LLT has been greater than a predetermined temperature for at least a predetermined time, terminate the defrosting;

b) if not, go to step W;

W. a) if the predetermined maximum time for defrosting MPDI has elapsed, terminate the defrosting;

b) if not, go to step P. Such a method typically comprises also the steps

X. a) rapidly decrease the engine speed ES to a predetermined speed, b) switch the reversing valve to the heating mode, c) initialize tsD to zero, and d) increase or decrease the engine speed ES to the speed requested by the thermostat, and go to step Y;

Y. a) if ttD is less than OttD, go to step Z;

b) if not, go to step AA;

Z. compute a new PDI for the next defrosting, according to PDI equals DI times SSAi times OttD divided by ttD (from step T); and signal the system to start the outdoor (OD) fan;

AA. compute a new PDI for the next defrosting, according to PDI equals DI times SSAd times OttD divided by ttD (from step T); and signal the system to start the outdoor (OD) fan.

Typically the starting of the outdoor fan is controlled in accordance with the steps BB. a) if the engine has been running for more than a predetermined time since the completion of step X, turn on the outdoor (OD) fan;

b) if not, go to step CC;

CC. a) if LLT is less than a predetermined temperature, turn on the outdoor (OD) fan;

b) if not, go to step DD;

DD. a) if LLT is less than the outdoor dry bulb temperature ODT, turn on the outdoor (OD) fan;

b) if not, go to step BB.

Turning on the outdoor (OD) fan, typically begins another defrosting cycle.

Typical preferred further details include the following:

A. the predetermined maximum time MtsD in step A is about 72 to 96 hours; (typically about 72 to 78)

B. the minimum predicted defrost interval mPDI is set to about ½ to ¾ hours, the maximum predicted defrost interval MPDI is set to about 8 to 12 hours, and the default predicted defrost interval dPDI is set to about 2 to 2½ hours;

E. the predetermined higher temperature pHT in step E is about 40° to 50° F.; (typically about 45)

F. the predetermined lower temperature pLT in step F is about 30° to 40° F.; (typically about 36)

Figure 8:
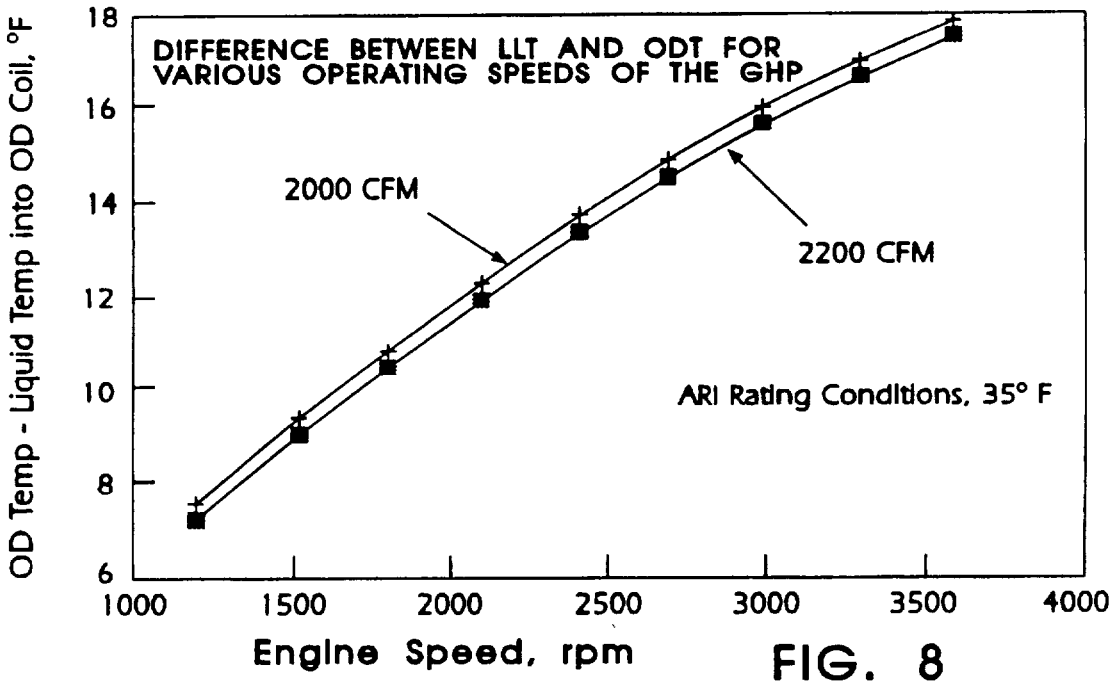
FIG. 8 is a graph showing the difference between the outdoor temperature ODT and the liquid line temperature LLT for different operating speeds of a typical heat pump system such as that of FIGS. 5 and 6.

H. the predetermined value of ODT minus LLT in step H is a function of ES as shown in FIG. 8 for which the coil usually is just barely clear, plus about 2° to 5° F.; (typically about 3)

I. the predetermined temperature in step I is about 30° to 34° F.; (typically about 32)

J. the value of tsD in step J is reduced in accordance with an empirically predetermined function of ODT and elapsed time in the form of $tsD=tsD-b(ODT-32)\Delta T$, where b is in the range of about 0.01 to 0.02; (typically about 0.015)

Figure 9:
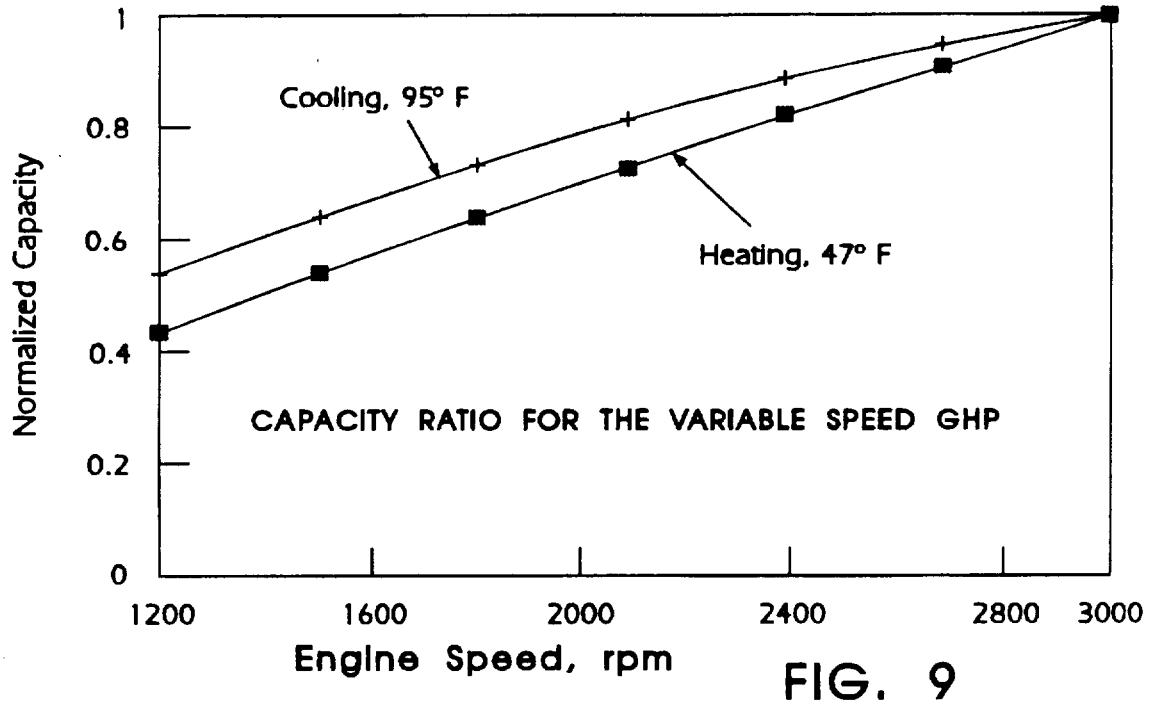
FIG. 9 is a graph showing the capacity of a typical heat pump system such as that of FIG. 5 at different operating speeds normalized as fractions of the capacity at its maximum speed.

K. the value of tsD in step K is increased in accordance with an empirically predetermined function as shown in FIG. 9 of the actual time at speed divided by the estimated capacity at the present speed, the result being multiplied by the capacity at maximum speed.

Od. the function of AES and AODT in step Od is OttD=(a function to be inserted here);

Oe. the predetermined engine speed pES in step Oe is about 1400 to 1600 rpm; (typically about 1500)

Oj. the predetermined maximum engine speed pMES in step 0j is about 2900 to 3100 rpm; (typically about 3000)

Q. each rate of change of LLT with respect to time $\Delta LLT/\Delta t$ in step Q is computed with $\Delta t$ of about 1 millisecond to 10 seconds; (typically about one second)

R. the predetermined time in step R is about 0.8 to 1.2 minutes; (typically about one)

Ua. the predetermined temperature in step Ua is about 65° to 75° F.; (typically about 70) Val. the predetermined temperature in step Va is about 40° to 50° F.; (typically about 45)

Va2. the predetermined time in step Va is about 1 to 3 minutes; (typically about 2)

W. The predetermined maximum time for defrosting MPDI is about 12 to 20 minutes (or is computed by method of determining);

Xa. the predetermined speed in step Xa is about 1400 to 1600 rpm; (Typically about 1500)

Z. SSAi is about 0.6 to 1.2; (typically about 0.9)

AA. SSAd is about 1.2 to 2; (typically about 1.6)

BBa. the predetermined time in step BBa is about 3 to 7 minutes; (typically about 5)

CCa. the predetermined temperature in step CCa is about 30° to 40° F. (typically about 36)

Suitable apparatus for carrying out a method as described above typically comprises a combination of means for performing each step in the manner and sequence set forth. Such a combination typically comprises electronic control means programmed to control the apparatus substantially according to the following listing in the C language for "Routines for implementing a demand defrost scheme for a variable speed engine driven gas heat pump, or substantially equivalently programmed, or wired to control the apparatus in a substantially equivalent manner:

```
/*

        Routines for implementing demand defrost scheme
        for a variable speed engine driven Gas Heat Pump


input drivers required for:

    ODT(void);
    LLT(void);
    eng_speed(void);
    eng_stat(void);
    Tstat_Y1(void);
    timer(void);

output drivers required for:

    tar_eng_speed(float);
    eng_ramp(float);
    OD_Fan(unsigned int);
    OD_Fan_Speed(unsigned int);

*/

//  Function Prototypes

check_defrost(void);
defrost(void);
defrost_enter(void);
defrost_exit(void);
fract_capacity(void);
init_defrost(void);
OD_coil_limit(ave_eng_speed);
optim_defrost(void);

float ttD=0., di=0., tsd = 0.;
float base_time,
float pdi, min_PDI, max_PDI;
float ODT_save;

check_defrost()

float elapst_time;
{
     elapst_time = timer() - base_time;
     if(ODT() > 45) tsd = 0; return;
     if(LLT() < 36){
          if(eng_stat() == OFF){
               tsd -= (ODT() - 32.) / 20. * elapst_time;
               if(tsd < 0) tsd = 0;
               return;}
```

```
        if(eng_stat() == ON){
            tsd += elapst_time * fract_capacity();
            if(ODT() - LLT() > OD_coil_limit(ave_eng_speed)) defrost();
            if(tsd < min_PDI) break;
            if(tsd > max_PDI) defrost(); break;
            if(tsd > pdi) defrost();}
        }

    return;
}

defrost()

{
    ODT_save = ODT();
    defrost_enter();

    ttD_start = ttD_timer = timer_last = timer();// Init. timers
    LLT_last = LLT();                    //  Store init LLT value
    Max_LLT_slope = 0.;                  //  Init LLT slope in Deg F/sec
    checkwt = timer();              //  Init timer for secondary crit.
    while (timer() - attD) < 15.){   //  Fifteen minute timeout
        if (tstat_Y1() != ON) defrost_exit(); return;
        if (LLT() < 70.) break;     //  Primary termination criteria
        if (LLT() < 45.) checkwt = timer();  //  Secondary criteria
        if ((timer() - checkwt) > 2.0) break;//  Condition must persist
        if (LLT() < 32.){                    //  Reset defrost timers
            ttD_start = ttD_timer = timer_last = timer();
            LLT_last = LLT();                //  Reset last LLT value
            Max_LLT_slope = 0.;}             //  Reset slope
        else{
            if ((timer_store = timer()) > timer_last + 0.1){
                //  Reset interval timer & check on 6 sec interval
                LLT_store = LLT();
                LLT_slope = (LLT_store - LLT_last)/(timer_store - timer_
                timer_last = timer_store;
                LLT_last = LLT_store;
                if (LLT_slope < 0.) LLT_slope = 0.; //  Use only + value
                if (LLT_slope > Max_LLT_slope){
                    Max_LLT_slope = LLT_slope;
                    ttD_timer = timer_store;
        }   }   }   }
    ttD = ttD_timer - ttD_start;        //  compute time to defrost
//  Alternate method for computing ttD if Max_LLT_slope fails
    if (Max_LLT_slope == 0.) ttD = timer() - attD - 1.725 + ODT_save/60.;
    di = tsd;        //   compute defrost interval and reset tsd
    tsd = 0.;        //   for successful defrost

    defrost_exit();
    optim_defrost();
    return;
}
```

```
defrost_enter()

{
     if (eng_speed() > 1500.){  //  Reduce eng speed unless near min
             eng_ramp(35.);     //  Set ramp rate of 35 RPM/sec
             tar_eng_speed(1400.)}  //  Target engine speed
             base_time = timer();   //  Initialize timer
     while (eng_speed() > 1500){
         if (tstat_Y1() != ON) return;//  Exit if heat request ends
         if (timer() - base_time > 1.0) break;}//  Timeout of 1 min
      Rev_valve (ON);            //      Enter defrost mode
      OD_Fan (OFF);              //      Turn off outdoor fan
      attD = timer();            //      Initialize act. defrost timer

     Max_LLT_slope = 0.;         //      Initialize Max_LLT_slope
     eng_ramp(70.);              //      Set ramp rate of 70 RPM/sec
     tar_eng_speed(3000.);       //      Ramp to max engine speed
     return;
}


defrost_exit()

{
     eng_ramp(1000.);            //      Quick ramp to exit defrost
     tar_eng_speed(1400.);       //      Ramp to near min speed
     base_time = timer();        //      Initialize defrost exit timer
     while (eng_speed() > 1500){
         if(timer() - base_time > 0.08) break;}//  Timeout of 5 sec
     Rev_valve(OFF);             //      Switch to normal heating
     eng_ramp(35.);              //      Reset normal ramp rate
     return;
}

fract_capacity()

float fract_min_cap = 0.50;
float capacity_ratio;
{
     capacity_ratio = fract_min_cap +
          (1. - fract_min_cap)*(eng_speed() - 1200.)/1800.;
     if (capacity_ratio > 1.5) capacity_ratio = 1.5;
     if (capacity_ratio < .5) capacity_ratio = .5;
     return 1./capacity_ratio;
}
```

```
init_defrost()

float default_PDI = 60.0;          //  1 hour default defrost interval
{
     tsd = 0.;                     //  Initialize tsd
     min_PDI = default_PDI * 0.33; //  Min allowed is 20 min
     max_PDI = default_PDI * 8.0;  //  Max allowed is 8 hours
     pdi = default_PDI;            //  Assign initial pdi
     return;
}

OD_coil_limit(ave_eng_speed)

float ave_eng_speed;
{
    return 8.*(ave_eng_speed-1200.)/1800. + 10.;
}

main()

{
     init_defrost();
    .
    .
    .
     check_defrost();
    .
    .
    .
}

optim_defrost()

float ssa_inc = 1.1, ssa_dec = 0.85, optim_ttd;
{
     optim_ttd = 3. + 1.725 - ODT_save/60.;
     if (ttd < optim_ttd) pdi = di * ssa_inc * optim_ttd / ttd;
     else pdi = di * ssa_dec * optim_ttd / ttd;
     if (pdi < min_PDI) pdi = min_PDI;
     if (pdi > max_PDI) pdi = max_PDI;
     return;
}
```

A typical method according to the invention may comprise also a similar equivalent combination of steps for defrosting the indoor coil in the heat pump system. Apparatus according to the invention then typically may comprise also an indoor coil liquid line temperature sensor 76 (FIGS. 6 and 7) and a similar equivalent combination of means to control the defrosting of the indoor coil.

APPLICABILITY

Figure 5:
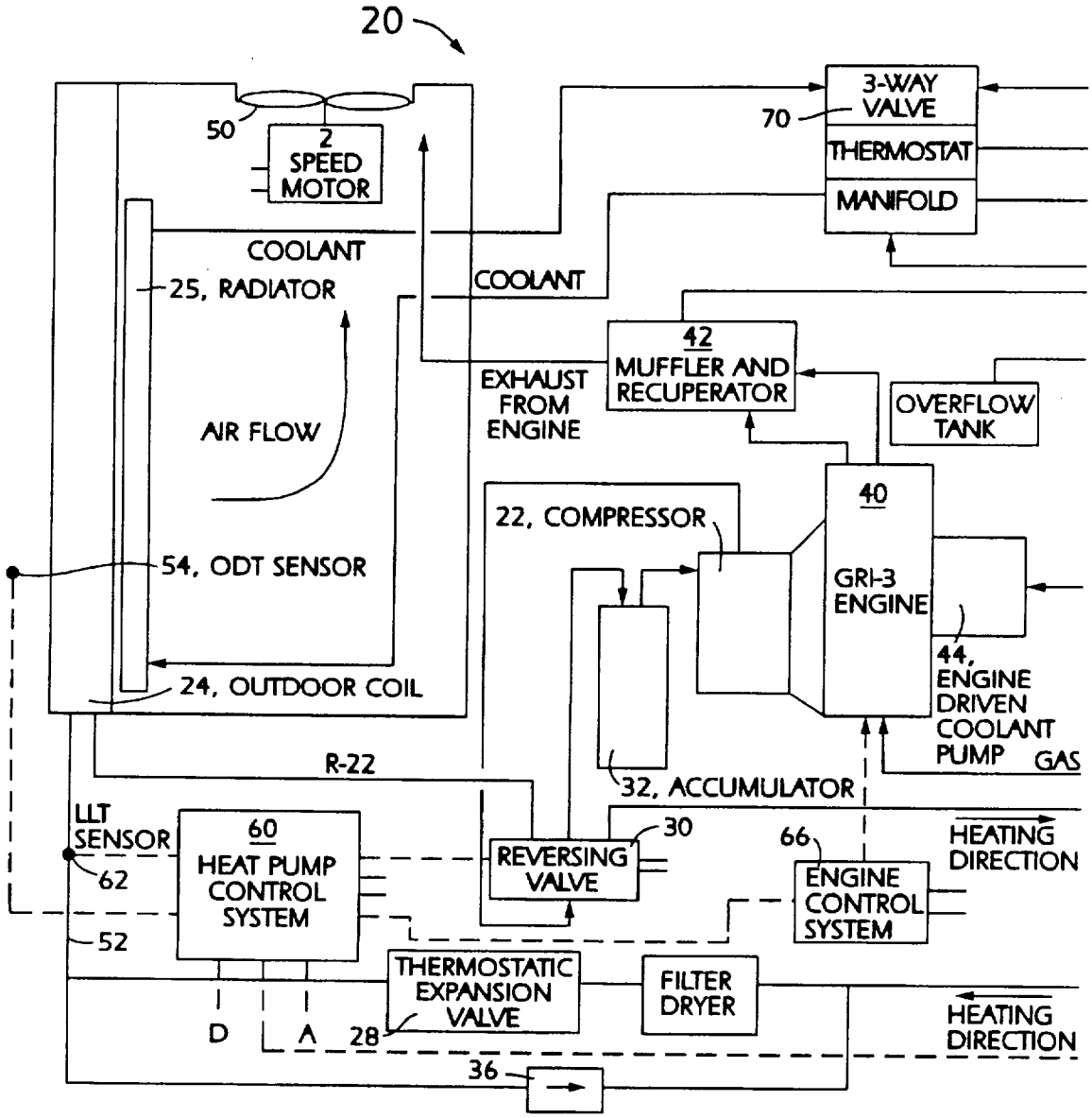
Figure 6:
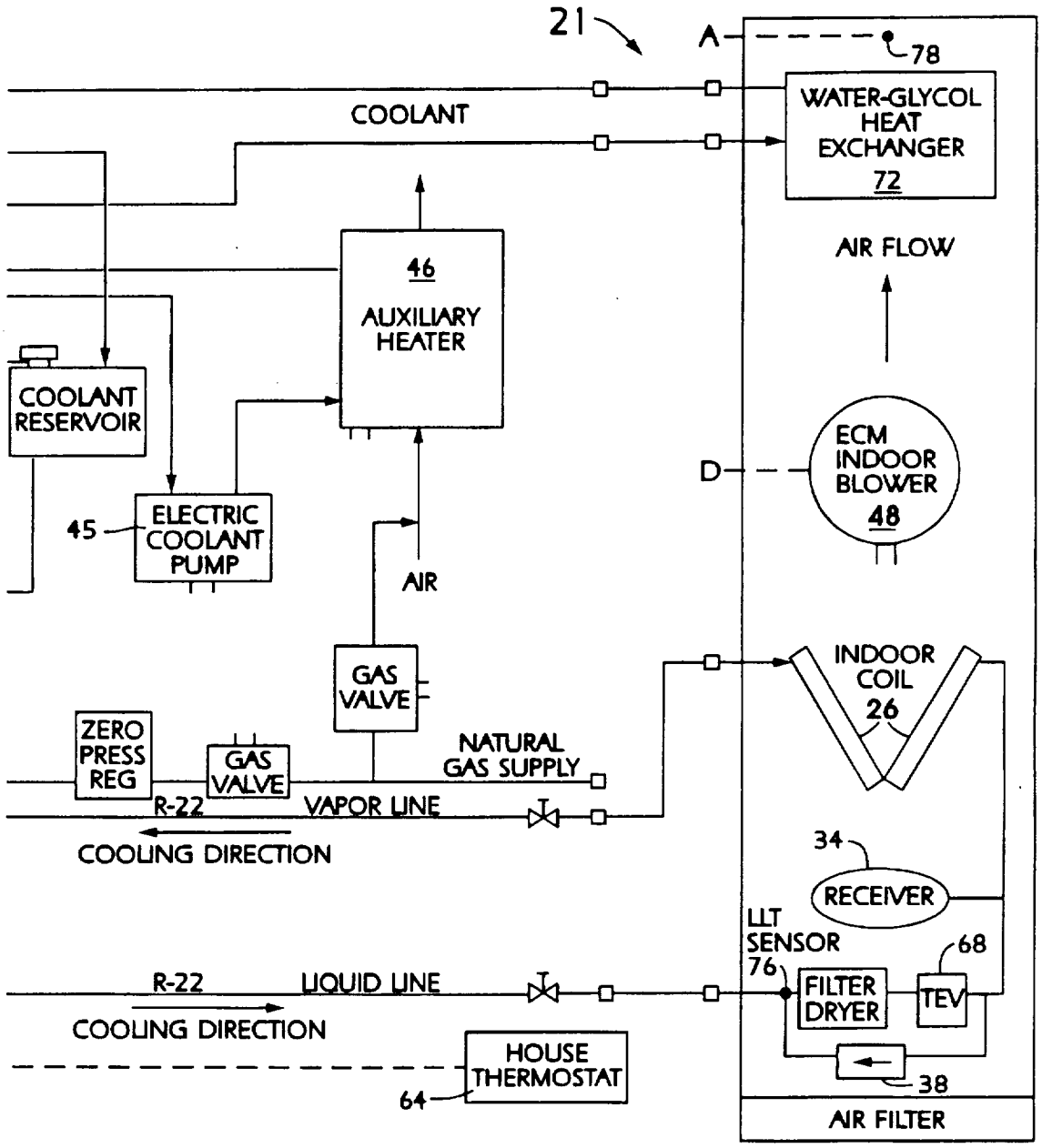
Figure 7:
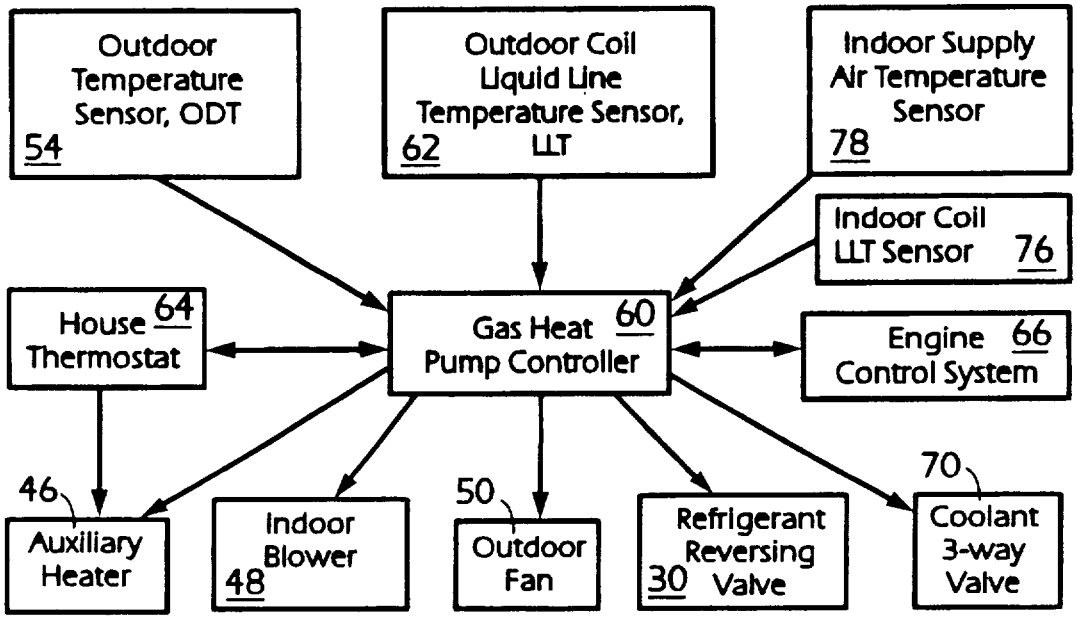
FIG. 7 is a block diagram of typical apparatus according to the present invention for defrosting a heat pump system as in FIGS. 5 and 6.
Figure 10:
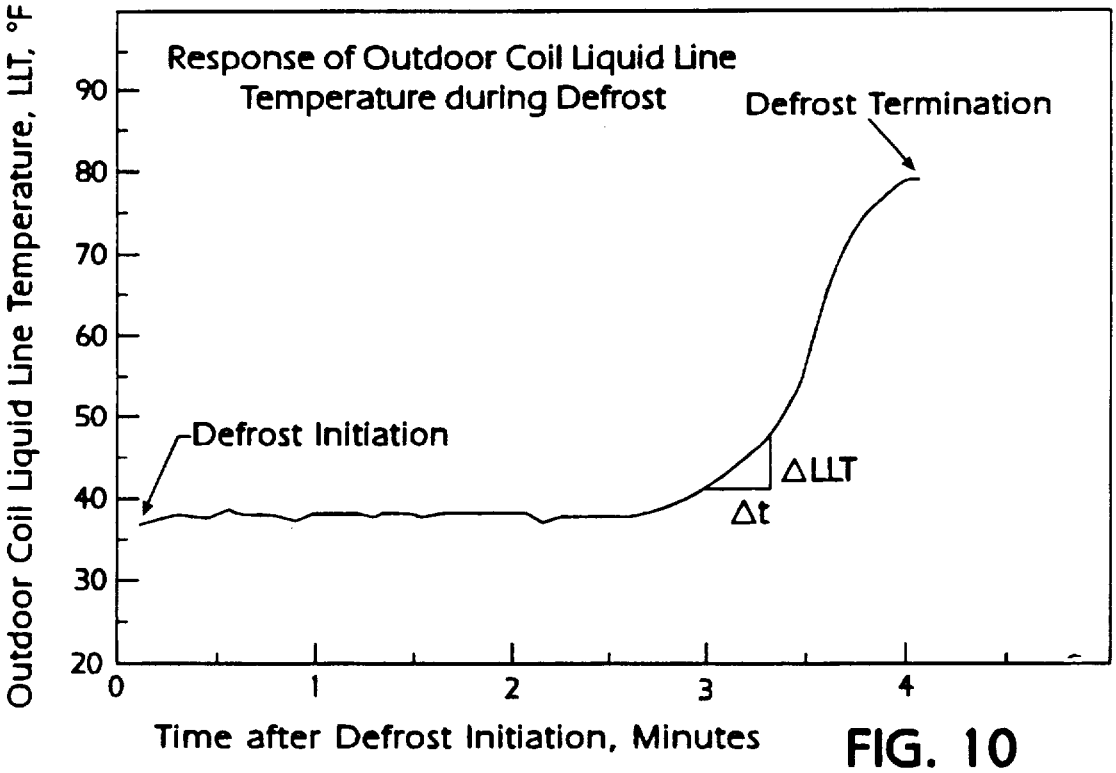
FIG. 10 is a graph showing the liquid line temperature in the outdoor coil from the start to the end of a typical defrosting cycle according to the present invention at normal outdoor temperatures.

A typical gas engine driven heat pump system in which the present invention can be advantageously applied is shown in FIGS. 5 and 6.

Generally speaking, any device that transfers heat from a low temperature region to a region of higher temperature is referred to as a heat pump. A refrigerator transfers heat from the cold freezer compartment to the room. An air conditioner transfers heat from the cool, conditioned space to the warmer outdoors. Both of these heat pumping applications predated the current space conditioning heat pump. Now the term heat pump is used to describe a reversible heat pumping device that can be used for both heating and cooling.

Various processes can be used to pump heat including vapor compression, absorption, and desiccant systems. Vapor compression is the most commonly used system for residential space conditioning. The gas engine heat pump 20,21 of FIGS. 5 and 6 uses a vapor compression system.

The four main components of the vapor compression system 20,21 are the compressor 22, the condenser 24 or 26, the pressure reducing device 28 or 68, and the evaporator 26 or 24. The compressor 22 receives refrigerant vapor at low pressure and temperature from the evaporator 26 or 24 and discharges it at an elevated pressure and temperature. The high pressure vapor then enters the condenser 24 or 26 where its temperature is reduced sufficiently to cause the vapor to condense into liquid. Heat is given off from the refrigerant during condensation. The liquid refrigerant then passes through the pressure reducing device 28 where the pressure is reduced. The reduced pressure is sufficiently low that the liquid refrigerant begins to change phase. The refrigerant must absorb heat from the evaporator 26 or 24 to become vapor. The vapor then returns to the compressor 22 where the process begins again.

The heat pump is basically a reversible air conditioner. Thus, the relative location of the condenser and evaporator depend on whether the unit is heating or cooling the house. In the cooling mode, the condenser 24 is outside and the evaporator 26 is inside. In the heating mode, the evaporator 24 is outside and the condenser 26 is inside. The heat pump contains a reversing valve 30 which acts to reverse the direction of refrigerant flow when changing from cooling to heating. The reversing valve is also used as needed in the winter to defrost the outdoor evaporator 24. During defrosting, the vapor compression cycle is reversed to heat up the evaporator 24 to melt any frost that has formed.

A heat pump typically has several other parts that are not required for an air conditioner. A heat pump may also contain an accumulator 32 and possibly a liquid receiver 34 to store the excess refrigerant. A heat pump may have two pressure reducing devices 28, 68; one 68 inside, and one 28 outside; and check valves 36, 38 that divert the refrigerant through them as the direction of the refrigerant flow changes.

The vapor compression portion of the gas engine heat pump is nearly identical to that of conventional electrically-driven heat pumps. The system is serviced with the same methods and equipment that are used for electrically-powered systems.

The most noticeable difference between gas and electric heat pumps is the power source for the compressor. A single-cylinder natural gas engine 40 is substituted for the electric motor of conventional systems. The gas engine 40 typically is capable of efficient continuous operation between about 1200 and 3000 RPM. Thus, the heat pumping capacity of the system can be varied continuously from 40 percent to 100 percent of maximum to match the requirements of the house and the weather. Variable speed operation means greater comfort, as on/off cycling is not required unless the load drops below 40 percent of the maximum. It also means greater efficiency, since the maximum efficiency is realized at reduced speeds.

The engine cooling system is unique to the gas heat pump. The cooling system maintains the proper operating temperature of the engine regardless of outdoor temperature or operating conditions. In the winter, the waste heat from the engine 40 is rejected via a muffler and recuperator 42, and a pump 44, into a heat exchanger 26 in the house, to supplement the heat from the vapor compression system.

The ability to recover nearly all of the energy from the natural gas is what makes the gas engine heat pump so efficient in winter heating. It also provides for high delivered air temperatures in heating without sacrificing efficiency. This is possible because the heat from the coolant is added to the indoor air after it has already passed over the vapor compression heat exchanger. In the summer, the waste heat from the engine 40 is rejected into an outdoor radiator 25 mounted downstream of the refrigerant heat exchanger (the outdoor coil) 24.

The availability of the waste heat from the engine means that the gas engine heat pump can operate without supplemental heat at temperatures where electric heat pumps cannot. The heat pumping capacity of the vapor compression cycle decreases as the temperature difference between the evaporator and condenser increases. Typically, as the temperature outside approaches 30° F., the capacity of the vapor compression system diminishes to the point that supplemental heat may be required. In most electric heat pumps, the supplemental heat is provided by expensive to operate electric resistance heaters. By adding the waste heat of the engine to the vapor compression cycle heat, the gas heat pump is capable of operating without supplemental heat at temperatures at least about 20° F. colder.

For most of the heating season, supplemental heat will rarely be required, even in northern climates. However, a gas-fired auxiliary heating system 46 has been included for use when needed. Supplemental heat comes on automatically during defrosting to prevent cold drafts, at temperatures below which the heat pump capacity is insufficient, if the vapor compression system fails, or if the outside temperature drops below −10° F. If the temperature drops below −10° F. the engine 40 shuts down to prevent damage to the compressor 22 and remains off until the temperature rises above −5° F.

Two optional auxiliary heating systems have been developed for the gas engine heat pump. One system uses a gas fired boiler 46 in the outdoor unit to add additional heat to the engine coolant before it is pumped into the indoor heat exchanger 72. A separate electrically-driven coolant pump 44 is also provided so that the boiler can operate with the engine off. The other system (not shown) uses domestic hot water from the home water heater as a source of additional heat. A separate potable water heat exchanger is installed in the indoor unit along with the coolant heat exchanger 72. An electrically-driven circulating pump (not shown) moves water from the hot water tank to the heat exchanger and back to the water tank. A check valve is also included, to prevent unwanted thermal siphoning when the pump is turned off.

Both systems have been successfully used in cold climates. The domestic water system is particularly desirable in warmer climates where the existing hot water tank generally has sufficient capacity. In colder climates, a larger hot water tank may be required.

A variable speed indoor blower 48 is used with the gas engine heat pump to minimize electrical consumption and maximize the comfort advantages of the variable speed engine 40. The fan speed varies smoothly in proportion to the engine speed to maintain a more constant delivered air temperature and humidity in the house. On moderate heating or cooling days, the fan will operate quietly and continuously at low speed for maximum efficiency. Efficient continuous fan operation can be provided at low speed for enhanced air filtration or reduced stratification in multi-story houses.

A two-speed outdoor fan 50 is also used to minimize electricity consumption. The fan runs at maximum speed only when maximum heating or cooling is required. Most of the time the fan is running at the quieter and more efficient low speed.

To summarize:

Typical apparatus 20,21 according to the present invention for defrosting the outdoor coil in a variable speed heat pump system having the components and parameters referred to herein includes; apparatus 54,60,62,30 for determining, after the end of the last preceding defrosting, at least approximately the optimal time to begin the next defrosting, and then signalling the system to initiate the defrosting, comprising a) a heat pump control system 60 having means for measuring, either continuously or periodically, the time interval since the end of the last defrosting tsD, the averages, over time, of liquid line temperature LLT (via a sensor 62), speed ES of the engine 40 that drives the compressor 22 (via an engine control system 66), and outdoor dry bulb temperature ODT (via a sensor 54);

b) data processing means in the heat pump control system 60 responsive to the measuring means a), for determining when one of the following conditions has come about:

i. the difference ODT minus LLT exceeds a predetermined value for the engine speed ES, indicating that the coil is not substantially clear of frost, or ii. tsD is greater than a predetermined maximum time interval to be permitted since the last defrosting MPDI, or iii. tsD is greater than a predetermined minimum time interval and is greater than a predicted defrost interval PDI that has been predetermined by data from the last defrosting; and c) data processing means in the heat pump control system 60, responsive to a determination that a said condition i, ii, or iii has come about, for providing a signal to initiate the defrosting.

Such apparatus 20,21 for defrosting the outdoor coil in a variable speed heat pump system having the components and parameters referred to therein and those referred to herein; typically includes also apparatus 54,60,62,30, responsive to a signal via c) to initiate the defrosting, for carrying out the defrosting and terminating it at least approximately at the optimal time, comprising d) means including a refrigerant reversing valve 30 for switching the system to the defrost mode, at a predetermined maximum engine speed pMES (via the engine control system 66), e) data processing means in the heat pump controller 60 for periodically measuring the time taken during the defrosting ttD and the liquid line temperature LLT (62), f) data processing means in the heat pump controller 60 for periodically computing the rate of change of LLT (62) with respect to time $\Delta LLT/\Delta t$, g) data processing means in the heat pump controller 60 responsive to a value of $\Delta LLT/\Delta t$ that is greater than the previous maximum value, when ttD is greater than a predetermined time, for storing the value of each in place of its preceding value, h) data processing means in the heat pump controller 60 for determining when one of the following conditions has come about:

i. LLT is greater than a first predetermined temperature, or ii. LLT has been greater than a second predetermined temperature for at least a predetermined time, or iii. a predetermined maximum time for defrosting MPDI has elapsed; and i) data processing means in the heat pump controller 60, responsive to a determination that a said condition i, ii, or iii has come about, for terminating the defrosting.

The apparatus 20,21 typically comprises also, responsive to a termination of the defrosting, j) refrigerant reversing valve means 30 for switching the system to the heating mode, k) engine control system means 66 for decreasing the engine speed ES to a speed responsive to the setting of the thermostat 64 in the space that is heated by the heat pump, l) data processing means in the heat pump controller 60 for computing a predicted defrost interval PDI for the next defrosting, proportional to a predetermined optimal time to defrost OttD divided by ttD, and m) means for starting the outdoor fan 50.

The means m) typically comprises data processing means in heat pump controller 60 for starting the outdoor fan 50 when of the following conditions has come about:

n) the engine has been running for more than a predetermined time since its speed was decreased (k)), or o) LLT (62) is less than a predetermined temperature, or p) LLT (62) is less than the outdoor dry bulb temperature ODT (54).

The phrase "increment the timer" is used herein to mean "to start the timer and cause it to measure the time that has elapsed since it was started."

The terms "increment" and "decrement" are used as verbs herein to mean generally to increase and decrease, respectively, the value of a quantity as a function of at least one other quantity.

While the forms of the invention herein disclosed constitute currently preferred embodiments, many others are possible. It is not intended herein to mention all of the possible equivalent forms or ramifications of the invention. It is to be understood that the terms used herein are merely descriptive rather than limiting, and that various changes may be made without departing from the spirit or scope of the invention.

I claim:

1. In a method of defrosting the outdoor coil (24) in a heat pump system (20,21) having the components and parameters referred to herein; a method for determining, after the end of the last preceding defrosting, at least approximately the optimal time to begin the next defrosting, and then signalling the system to initiate the defrosting, comprising the steps a) either continuously or periodically measure the time interval since the end of the last defrosting tsD, the averages, over time, of liquid line temperature LLT, speed ES of the engine (40) that drives the compressor (22), and outdoor dry bulb (54) temperature ODT; and b) provide a signal to initiate the defrosting when one of the following conditions comes about:

i. the difference ODT minus LLT exceeds a predetermined value, indicating that the coil is not substantially clear of frost, or ii. tsD is greater than a predetermined maximum time interval to be permitted since the last defrosting MPDI, or iii. tsD is greater than a predetermined minimum time interval and is greater than a predicted defrost interval PDI that has been predetermined by data from the last defrosting.

2. In a method as in claim 1 of defrosting the outdoor coil (24) in a heat pump system (20,21) having the components and parameters referred to therein and those referred to herein, wherein the system has been signalled to initiate the defrosting; a method for carrying out the defrosting, and terminating it at least approximately at the optimal time, comprising the steps d) switch (30) the system to the defrost mode, e) periodically measure the time taken during the defrosting ttD and the liquid line (52) temperature LLT, f) periodically compute the rate of change of LLT with respect to time $\Delta LLT/\Delta t$, g) when $\Delta LLT/\Delta t$ is greater than the previous maximum value and ttD is greater than a predetermined time, store the value of each in place of its preceding value, and h) terminate the defrosting when one of the following conditions comes about:

i. LLT is greater than a first predetermined temperature, or ii. LLT has been greater than a second predetermined temperature for at least a predetermined time, or iii. a predetermined maximum time for defrosting MPDI has elapsed.

3. A method as in claim 2, comprising also, after step h, the steps j) switch (30) the system (20,21) to the heating mode, k) compute a predicted defrost interval PDI for the next defrosting, proportional to a predetermined optimal time to defrost OttD divided by ttD, and l) start the outdoor fan (50).

4. A method as in claim 3, wherein the outdoor fan is started when one of the following conditions comes about:

m) the engine (40) has been running for more than a predetermined time since defrosting was terminated, or n) LLT is less than a predetermined temperature, or o) LLT is less than the outdoor dry bulb (54) temperature ODT.

5. In a method of defrosting the outdoor coil in a variable speed heat pump system having the components and parameters referred to herein; a method according to claim 1 for determining at least approximately the optimal time to initiate a defrosting, and then signalling the system to begin the defrosting, comprising the steps A. a) if the time interval since the end of the last defrosting tsD is at least a predetermined maximum time MtsD, go to step B;

b) if not, go to step D;

B. set the respective system parameters to predetermined values of predicted defrost interval PDI: namely minimum mPDI, maximum MPDI, and default dPDI;

C. initialize the value of tsD to zero;

D. read and average, over time, the values of liquid line temperature LLT, speed ES of the engine that drives the compressor, and outdoor dry bulb temperature ODT;

E. a) if ODT is less than a predetermined higher temperature pHT, go to step F;

b) if not, go to step D;

F. a) if LLT is less than a predetermined lower temperature pLT, go to step G;

b) if not, go to step C;

G. a) if the engine is running, go to step H;

b) if not, go to step I;

H. a) if the difference ODT minus LLT exceeds a predetermined value for the current engine speed ES, and thus indicates that the coil is not substantially clear of frost, signal the system to begin the defrosting;

b) if not, go to step K;

I. a) if ODT is greater than a predetermined temperature, go to step J;

b) if not, go to step D;

J. reduce the value of tsD as a predetermined function of ODT and elapsed time, and go to step D;

K. increase the value of tsD as a predetermined function of the actual time at the present engine speed multiplied by the estimated capacity of the heat pump system at the present speed divided by the capacity at the maximum speed;

L. a) if tsD is greater than a predetermined maximum time permitted since the last defrost (maximum permitted defrost interval) MPDI, signal the system to begin the defrosting;

b) if not, go to step M;

M. a) if tsD is greater than a predetermined minimum time permitted since the last defrost (minimum permitted defrost interval) mPDI, go to step N;

b) if not, go to step D;

N. a) if tsD is greater than the PDI, signal the system to begin the defrosting;

b) if not, go to step D.

6. In a method of defrosting the outdoor coil in a variable speed heat pump system having the components and parameters referred to herein, wherein the system has been signalled to begin defrosting; a method according to claim 2 for carrying out the defrosting, and terminating it at least approximately at the optimal time, comprising the steps O. a. record the defrost interval DI, b. compute the average engine speed AES, c. compute the average outdoor dry bulb temperature AODT, d. determine the optimal time to defrost OttD as an empirically predetermined function of AES and AODT, e. gradually reduce the engine speed ES to a predetermined engine speed pES, f. switch the reversing valve to the defrost mode, g. turn off the outdoor (OD) fan, h. reset to zero the timer that measures the time taken to defrost ttD, i. initialize the maximum value of the rate of change of LLT with respect to time MΔLLT/Δt equal to zero, and j. gradually increase the engine speed ES to a predetermined maximum engine speed pMES;

P. increment the timer that measures ttD, and go to step Q;

Q. compute the rate of change of LLT with respect to time ΔLLT/Δt;

R. a) if ΔLLT/Δt is greater than the previous maximum value and ttD is greater than a predetermined time, go to step S;

b) if not, go to step U;

S. set MΔLLT/Δt to ΔLLT/Δt;

T. store the value of ttD;

U. a) if LLT is greater than a predetermined temperature, terminate the defrosting;

b) if not, go to step V;

V. a) if LLT has been greater than a predetermined temperature for at least a predetermined time, terminate the defrosting;

b) if not, go to step W;

W. a) if the predetermined maximum time for defrosting MPDI has elapsed, terminate the defrosting;

b) if not, go to step P.

7. A method as in claim 6, comprising also the steps

X. a) rapidly decrease the engine speed ES to a predetermined speed, b) switch the reversing valve to the heating mode, c) initialize tsD to zero, and d) increase or decrease the engine speed ES to the speed requested by the thermostat;

Y. a) if ttD is less than OttD, go to step Z;

b) if not, go to step AA;

Z. compute a new PDI for the next defrosting, according to PDI equals DI times SSAi times OttD divided by ttD (from step T); to start the outdoor (OD) fan and omit step AA;

AA. compute a new PDI for the next defrosting, according to PDI equals DI times SSAd times OttD divided by ttD (from step T); and start the outdoor (OD) fan.

8. A method as in claim 7, wherein the starting of the outdoor fan is controlled in accordance with the steps BB. a) if the engine has been running for more than a predetermined time since the completion of step X, turn on the outdoor (OD) fan and omit steps CC and DD;

b) if not, go to step CC;

CC. a) if LLT is less than a predetermined temperature, turn on the outdoor (OD) fan and omit step DD;

b) if not, go to step DD;

DD. a) if LLT is less than the outdoor dry bulb temperature ODT, turn on the outdoor (OD) fan;

b) if not, go to step BB.

9. A method as in claim 7, wherein the starting of the outdoor fan is controlled in according with the steps BB. a) if the engine has been running for more than a predetermined time since the completion of step X, go to step EE;

b) if not, go to step CC;

CC. a) if LLT is less than a predetermined temperature, go to step EE;

b) if not, go to step DD;

DD. a) if LLT is less than the outdoor dry bulb temperature ODT, go to step EE;

b) if not, go to step BB.

EE. turn on the outdoor (OD) fan, and begin another defrosting cycle.

10. A method of defrosting the outdoor coil in a variable speed heat pump system having the components and parameters referred to herein; comprising a method for determining at least approximately the optimal time to initiate a defrosting, and then signalling the system to begin the defrosting, comprising the steps A. a) if the time interval since the end of the last defrosting tsD is at least a predetermined maximum time MtsD, go to step B;

b) if not, go to step D;

B. set the respective system parameters to predetermined values of predicted defrost interval PDI: namely minimum mPDI, maximum MPDI, and default dPDI;

C. initialize the value of tsD to zero;

D. read and average, over time, the values of liquid line temperature LLT, speed ES of the engine that drives the compressor, and outdoor dry bulb temperature ODT;

E. a) if ODT is less than a predetermined higher temperature pHT, go to step F;

b) if not, go to step D;

F. a) if LLT is less than a predetermined lower temperature pLT, go to step G;

b) if not, go to step C;

G. a) if the engine is running, go to step H;

b) if not, go to step I;

H. a) if the difference ODT minus LLT exceeds a predetermined value for the current engine speed ES, and thus indicates that the coil is not substantially clear of frost, signal the system to begin the defrosting;

b) if not, go to step K;

I. a) if ODT is greater than a predetermined temperature, go to step J;

b) if not, go to step D;

J. reduce the value of tsD as a predetermined function of ODT and elapsed time, and go to step D;

K. increase the value of tsD as a predetermined function of the actual time at the present engine speed multiplied by the estimated capacity of the heat pump system at the present speed divided by the capacity at the maximum speed;

L. a) if tsD is greater than a predetermined maximum time permitted since the last defrost (maximum permitted defrost interval) MPDI, signal the system to begin the defrosting;

b) if not, go to step M;

M. a) if tsD is greater than a predetermined minimum time permitted since the last defrost (minimum permitted defrost interval) mPDI, go to step N;

b) if not, go to step D;

N. a) if tsD is greater than the PDI, signal the system to begin the defrosting;

b) if not, go to step D;

said method of defrosting further comprising a method for carrying out the defrosting, and terminating it at least approximately at the optimal time, comprising the steps O. a. record the defrost interval DI, b. compute the average engine speed AES, c. compute the average outdoor dry bulb temperature AODT, d. determine the optimal time to defrost OttD as an empirically predetermined function of AES and AODT, e. gradually reduce the engine speed ES to a predetermined engine speed pES, f. switch the reversing valve to the defrost mode, g. turn off the outdoor (OD) fan, h. reset to zero the timer that measures the time taken to defrost ttD, i. initialize the maximum value of the rate of change of LLT with respect to time MΔLLT/Δt equal to zero, and j. gradually increase the engine speed ES to a predetermined maximum engine speed pMES;

P. increment the timer that measures ttD;

Q. compute the rate of change of LLT with respect to time ΔLLT/Δt;

R. a) if ΔLLT/Δt is greater than the previous maximum value and ttD is greater than a predetermined time, go to step S;

b) if not, go to step U;

S. set MΔLLT/Δt to ΔLLT/Δt;

T. store the value of ttD;

U. a) if LLT is greater than a predetermined temperature, terminate the defrosting;

b) if not, go to step V;

V. a) if LLT has been greater than a predetermined temperature for at least a predetermined time, terminate the defrosting;

b) if not, go to step W;

W. a) if the predetermined maximum time for defrosting MPDI has elapsed, terminate the defrosting;

b) if not, go to step P;

said method comprising also the steps

X. a) rapidly decrease the engine speed ES to a predetermined speed, b) switch the reversing valve to the heating mode, c) initialize tsD to zero, and d) increase or decrease the engine speed ES to the speed requested by the thermostat;

Y. a) if ttD is less than OttD, go to step Z;

b) if not, go to step AA;

Z. compute a new PDI for the next defrosting, according to PDI equals DI times SSAi times OttD divided by ttD (from step T); start the outdoor (OD) fan and omit step AA;

AA. compute a new PDI for the next defrosting, according to PDI equals DI times SSAd times OttD divided by ttD (from step T); and start the outdoor (OD) fan;

the starting of the outdoor fan being controlled in accordance with the steps

BB. a) if the engine has been running for more than a predetermined time since the completion of step X, go to step EE;

b) if not, go to step CC;

CC. a) if LLT is less than a predetermined temperature, go to step EE;

b) if not, go to step DD;

DD. a) if LLT is less than the outdoor dry bulb temperature ODT, go to step EE;

b) if not, go to step BB.

EE. turn on the outdoor (OD) fan, and begin another defrosting cycle.

11. A method as in claim 10, including also at least one of the following limitations:

A. the predetermined maximum time MtsD in step A is about 72 to 96 hours;

B. the minimum predicted defrost interval mPDI is set to about ½ to ¾ hours, the maximum predicted defrost interval MPDI is set to about 8 to 12 hours, and the default predicted defrost interval dPDI is set to about 2 to 2½ hours;

E. the predetermined higher temperature pHT in step E is about 40° to 50° F.;

F. the predetermined lower temperature pLT in step F is about 30° to 40° F.;

H. the predetermined value of ODT minus LLT in step H is a function of ES for which the coil usually is just barely clear, plus about 2° to 5° F.;

I. the predetermined temperature in step I is about 30° to 34° F.;

J. the value of tsD in step J is reduced in accordance with an empirically predetermined function of ODT and elapsed time in the form of tsD=tsD−b(ODT− 32)ΔT where b is in the range of about 0.01 to 0.02; and K. the value of tsD in step K is increased in accordance with an empirically predetermined function of the actual time at speed divided by the estimated capacity at the present speed, the result being multiplied by the capacity at maximum speed;

Oe. the predetermined engine speed pES in step Oe is about 1400 to 1600 rpm;

Oj. the predetermined maximum engine speed pMES in step Oj is about 2900 to 3100 rpm;

Q. each rate of change of LLT with respect to time ΔLLT/Δt in step Q is computed with Δt of about 1 millisecond to 10 seconds;

R. the predetermined time in step R is about 0.8 to 1.2 minutes;

Ua. the predetermined temperature in step Ua is about 65° to 75° F.;

Va1. the predetermined temperature in step Va is about 40° to 50° F.;

Va2. the predetermined time in step Va is about 1 to 3 minutes, and

W. The predetermined maximum time for defrosting MPDI is about 12 to 20 minutes;

Xa. the predetermined speed in step Xa is about 1400 to 1600 rpm;

Z. SSAi is about 0.6 to 1.2;

AA. SSAd is about 1.2 to 2;

BBa. the predetermined time in step BBa is about 3 to 7 minutes;

CCa. the predetermined temperature in step CCa is about 30° to 40° F.

12. In apparatus for defrosting the outdoor coil in a heat pump system having the components and parameters referred to herein; apparatus for determining, after the end of the last preceding defrosting, at least approximately the optimal time to begin the next defrosting, and then signalling the system to initiate the defrosting, comprising a) means for measuring, either continuously or periodically, the time interval since the end of the last defrosting tsD, the averages, over time, of liquid line temperature LLT, speed ES of the engine that drives the compressor, and outdoor dry bulb temperature ODT;

b) means responsive to the measuring means, for providing a signal to initiate the defrosting when one of the following conditions has come about:

i. the difference ODT minus LLT exceeds a predetermined value, indicating that the coil is not substantially clear of frost, or ii. tsD is greater than a predetermined maximum time interval to be permitted since the last defrosting MPDI, or iii. tsD is greater than a predetermined minimum time interval and is greater than a predicted defrost interval PDI that has been predetermined by data from the last defrosting.

13. Apparatus as in claim 12, having the components and parameters referred to therein and those referred to herein; comprising also apparatus responsive to a signal to initiate the defrosting, for carrying out the defrosting and terminating it at least approximately at the optimal time, comprising d) means for switching the system to the defrost mode at a predetermined maximum engine speed pMES, e) means for periodically measuring the time taken during the defrosting ttD and the liquid line temperature LLT, f) means for periodically computing the rate of change of LLT with respect to time $\Delta LLT/\Delta t$, g) means responsive to a value of $\Delta LLT/\Delta t$ that is greater than the previous maximum value, when ttD is greater than a predetermined time, for storing the value of each in place of its preceding value, h) means for terminating the defrosting when one of the following conditions has come about:

i. LLT is greater than a first predetermined temperature, or ii. LLT has been greater than a second predetermined temperature for at least a predetermined time, or iii. a predetermined maximum time for defrosting MPDI has elapsed.

14. Apparatus as in claim 13, comprising therein also, responsive to a termination of the defrosting, j) means for switching the system to the heating mode, k) means for decreasing the engine speed ES to a speed responsive to the setting of the thermostat, l) means for computing a predicted defrost interval PDI for the next defrosting, proportional to a predetermined optimal time to defrost OttD divided by ttD, and m) means for starting the outdoor fan.

15. Apparatus as in claim 14, wherein the means m) comprises means for starting the outdoor fan when any of the following conditions has come about:

n) the engine has been running for more than a predetermined time since its speed was decreased, or o) LLT is less than a predetermined temperature, or p) LLT is less than the outdoor dry bulb temperature ODT.

* * * * *